US009677163B2

(12) United States Patent
Makimizu et al.

(10) Patent No.: US 9,677,163 B2
(45) Date of Patent: Jun. 13, 2017

(54) HIGH STRENGTH GALVANIZED STEEL SHEET EXCELLENT IN TERMS OF COATING ADHESIVENESS AND METHOD FOR MANUFACTURING THE SAME

(75) Inventors: Yoichi Makimizu, Hiroshima (JP); Yoshitsugu Suzuki, Hiroshima (JP); Hideki Nagano, Kanagawa (JP); Shinjiro Kaneko, Chiba (JP)

(73) Assignee: JFE Steel Corporation (JP)

( * ) Notice: Subject to any disclaimer, the term of this patent is extended or adjusted under 35 U.S.C. 154(b) by 566 days.

(21) Appl. No.: 14/124,090

(22) PCT Filed: Jun. 6, 2012

(86) PCT No.: PCT/JP2012/065057

§ 371 (c)(1), (2), (4) Date: Feb. 25, 2014

(87) PCT Pub. No.: WO2012/169653

PCT Pub. Date: Dec. 13, 2012

(65) Prior Publication Data

US 2014/0220382 A1 Aug. 7, 2014

(30) Foreign Application Priority Data

Jun. 7, 2011 (JP) ..... 2011-126940
Apr. 2, 2012 (JP) ..... 2012-083489

(51) Int. Cl.

| | |
|---|---|
| ***C23C 2/02*** | (2006.01) |
| ***C23C 2/06*** | (2006.01) |
| ***C23C 2/28*** | (2006.01) |
| ***C21D 8/04*** | (2006.01) |
| ***C22C 38/02*** | (2006.01) |
| ***C22C 38/04*** | (2006.01) |
| ***C22C 38/34*** | (2006.01) |
| ***C22C 38/38*** | (2006.01) |
| *C21D 9/48* | (2006.01) |

(52) U.S. Cl.

CPC ..... *C23C 2/02* (2013.01); *C21D 8/0473* (2013.01); *C21D 8/0478* (2013.01); *C22C 38/02* (2013.01); *C22C 38/04* (2013.01); *C22C 38/34* (2013.01); *C22C 38/38* (2013.01); *C23C 2/06* (2013.01); *C23C 2/28* (2013.01); *C21D 9/48* (2013.01); *Y10T 428/12799* (2015.01)

(58) Field of Classification Search

CPC .. C23C 22/40; C23C 2/06; C23C 2/02; C23C 2/26

See application file for complete search history.

(56) References Cited

U.S. PATENT DOCUMENTS

| | | | | |
|---|---|---|---|---|
| 6,913,658 | B2 * | 7/2005 | Delaunay | C23C 2/02 148/579 |
| 7,687,152 | B2 * | 3/2010 | Ikematsu | C22C 38/02 148/533 |
| 2008/0308191 | A1 * | 12/2008 | Leuschner | C23C 2/12 148/242 |
| 2010/0186854 | A1 * | 7/2010 | Bertrand | C21D 9/46 148/276 |
| 2012/0325376 | A1 * | 12/2012 | Makimizu | C21D 1/74 148/284 |

FOREIGN PATENT DOCUMENTS

| | | |
|---|---|---|
| JP | 55-122865 | 9/1980 |
| JP | 04-202630 | 7/1992 |
| JP | 04-202631 | 7/1992 |
| JP | 04-202632 | 7/1992 |
| JP | 04-202633 | 7/1992 |
| JP | 04-254531 | 9/1992 |
| JP | 04-254532 | 9/1992 |
| JP | 07-034210 | 2/1995 |
| JP | 2008-184642 | 8/2006 |
| JP | 2006-233333 | 9/2006 |
| JP | 2007-211280 | 8/2007 |
| JP | 2008-248358 | 10/2008 |
| JP | 2009-242870 | 10/2009 |
| JP | 2010-174262 | 8/2010 |
| JP | 2010-202959 | 9/2010 |

OTHER PUBLICATIONS

Machine Translation, Matsuda, et al., JP 2008-248358, Oct. 2008.*
Korean Office Action dated May 2, 2016, of corresponding Korean Application No. 2013-7033165, along with a Concise Statement of Relevance of Office Action in English.

* cited by examiner

*Primary Examiner* — David Turocy
(74) *Attorney, Agent, or Firm* — DLA Piper LLP (US)

(57) ABSTRACT

A high strength galvanized steel sheet excellent in coating adhesiveness is made from a base material that is a high strength steel sheet containing Si, Mn, and Cr. A method includes performing an oxidation treatment on steel containing Si, Mn, and Cr in an oxidation furnace under the condition that a selected exit temperature T, reduction annealing and a galvanizing treatment, or optionally, further an alloying treatment under conditions that heating is performed at a temperature of 460° C. or higher and 600° C. or lower for an alloying treatment time of 10 seconds or more and 60 seconds or less.

10 Claims, 1 Drawing Sheet

HIGH STRENGTH GALVANIZED STEEL SHEET EXCELLENT IN TERMS OF COATING ADHESIVENESS AND METHOD FOR MANUFACTURING THE SAME

TECHNICAL FIELD

This disclosure relates to a high strength galvanized steel sheet excellent in terms of coating adhesiveness which is made from a high strength steel sheet containing Si, Mn, and Cr and a method of manufacturing the galvanized steel sheet.

BACKGROUND

Nowadays, steel sheets subjected to a surface treatment and thereby provided with a rust prevention property, in particular, galvanized steel sheets or galvannealed steel sheets which are excellent in terms of rust prevention property, are used as material steel sheets in the fields of, for example, automobiles, domestic electric appliances and building material industries. In addition, application of high strength steel sheets to automobiles is promoted to achieve a decrease in the weight and an increase in the strength of automobile bodies by decreasing the thickness of the materials of automobile bodies by increasing the strength of the materials from the viewpoint of an increase in the fuel efficiency of automobiles and the collision safety of automobiles.

In general, a galvanized steel sheet is manufactured by using a thin steel sheet, which is manufactured by hot-rolling and cold-rolling a slab, as a base material, by performing recrystallization annealing on the base material in an annealing furnace of a CGL and by thereafter galvanizing the annealed steel sheet. In addition, a galvannealed steel sheet is manufactured by further performing an alloying treatment on the galvanized steel sheet.

It is effective to add Si and Mn to increase the strength of a steel sheet. However, Si and Mn are oxidized and form oxidized materials of Si and Mn on the outermost surface of the steel sheet even in a reducing atmosphere of $N_2$+$H_2$ in which oxidation of Fe does not occur (oxidized Fe is reduced). Since the oxidized materials of Si and Mn decrease wettability between molten zinc and base steel sheet when a plating treatment is performed, bare spots frequently occur in the case of a steel sheet containing Si and Mn. In addition, even if bare spots do not occur, there is a problem in that coating adhesiveness is poor.

As a method of manufacturing a galvanized steel sheet using a high strength steel sheet containing a large amount of Si as a base material, Japanese Unexamined Patent Application Publication No. 55-122865 discloses a method in which reduction annealing is performed after an oxidized film has been formed on the surface of a steel sheet. However, the effect of JP '865 is not stably achieved. To solve this problem, Japanese Unexamined Patent Application Publication Nos. 4-202630, 4-202631, 4-202632, 4-202633, 4-254531, 4-254532 and 7-34210 disclose methods in which the oxidation rate or reduction amount is specified or in which the oxidation or reduction conditions are controlled on the basis of measurement results of the thickness of an oxidized film in a oxidation zone to stabilize the effect.

In addition, as a galvanized steel sheet which is made from a base material that is a high strength steel sheet containing Si and Mn, Japanese Unexamined Patent Application Publication No. 2006-233333 discloses a method in which the content ratios of oxides containing Si which are present in a coating layer and base steel of a galvannealed steel sheet are specified. In addition, Japanese Unexamined Patent Application Publication No. 2007-211280 specifies, as JP '333 does, the content ratios of oxides containing Si which are present in a coating layer and base steel of a galvanized and galvannealed steel sheet. In addition, Japanese Unexamined Patent Application Publication No. 2008-184642 specifies the amount of Si and Mn which are present in the form of oxides in a coating layer.

To highly increase the strength of a steel, it is effective to add chemical elements such as Si and Mn, which are effective for solid solution strengthening, as described above, and it is possible to increase hardenability of a steel and achieve a good balance of strength and ductility even in the case of high strength steel by further adding Cr. In particular, since press forming has to be performed in the case of a high strength steel sheet which is to be used for automobiles, there is a strong demand for an increase in the balance of strength and ductility.

It was found that, in the case where the methods of manufacturing a galvanized steel sheet which are disclosed by JP '865, JP '630, JP '631, JP '632, JP '633, JP '531, JP '532 and JP '210 are applied to steel in which Cr is added to a steel containing Si, sufficient coating adhesiveness is not necessarily achieved because oxidation in an oxidation zone is suppressed.

In addition, it was also found that, in the case where the methods of manufacturing a galvanized steel sheet which are disclosed by JP '865, JP '630, JP '631, JP '632, JP '633, JP '531, JP '532 and JP '210 are applied to steel in which Mn is added to a steel containing Si, good corrosion resistance is not necessarily achieved because crystal grains in the base steel are taken into a coating layer due to excessive internal oxidation in the case where an alloying treatment is performed.

In addition, it was found that, although good fatigue resistance is achieved using the methods which are disclosed by JP '333, JP 280 and JP '642 in the case of a galvanized steel sheet which is not subjected to an alloying treatment, there are cases where sufficient fatigue resistance is not always achieved in the case of a galvannealed steel sheet which is subjected to an alloying treatment. The methods disclosed by JP '333 and JP '280 are intended to increase coating wettability and phosphating performance, but fatigue resistance is not considered.

It could therefore be helpful to provide a high strength galvanized steel sheet excellent in terms of coating adhesiveness which is made from a base material that is a high strength steel sheet containing Si, Mn, and Cr and a method of manufacturing the galvanized steel sheet.

It could also be helpful to provide a high strength galvanized steel sheet excellent in terms of corrosion resistance and fatigue resistance which has been subjected to an alloying treatment.

SUMMARY

We found that, in the case where a high strength steel sheet containing Si, Mn, and Cr is used as a base material, a high Si high strength galvanized steel sheet excellent in terms of coating adhesiveness is achieved with stable quality without occurrence of bare spots by controlling an end-point (exit) temperature of oxidation treatment in an oxidation zone depending on the contents of added Si and Cr to form sufficient amount of iron oxides.

In addition, it is common that, to achieve good coating adhesiveness, an oxidation treatment is performed to form the oxides of Si and Mn on the surface layer of a steel sheet after a reduction annealing process. However, we found that, in the case where the oxides of Si and Mn are retained on the surface of the steel sheet under the coating layer after a galvanizing treatment and an alloying treatment have been performed after the oxidation treatment, there is a decrease in fatigue resistance due to the growth of cracks from the oxides serving as an origin.

We thus provide:

[1] A method for manufacturing a high strength galvanized steel sheet excellent in terms of coating adhesiveness, the method including performing an oxidation treatment on steel containing Si, Mn, and Cr in an oxidation furnace under the condition that an exit temperature T satisfies the expressions below, performing reduction annealing, and performing a galvanizing treatment without performing an alloying treatment:

$$A=0.015T-7.6\ (T\geq 507^\circ\ C.),$$

$$A=0\ (T<507^\circ\ C.),$$

$$B=0.0063T-2.8\ (T\geq 445^\circ\ C.),$$

$$B=0\ (T<445^\circ\ C.),$$

$$[Si]+A\times[Cr]\leq B,$$

where [Si]: Si content of the steel by mass %, and [Cr]: Cr content of the steel by mass %.

[2] A method for manufacturing a high strength galvanized steel sheet excellent in terms of coating adhesiveness, the method including performing an oxidation treatment on steel containing Si, Mn, and Cr in an oxidation furnace under the condition that an exit temperature T satisfies expressions below, performing reduction annealing, performing a galvanizing treatment, and performing an alloying treatment under the conditions that heating is performed at a temperature of 460° C. or higher and 600° C. or lower for an alloying treatment time of 10 seconds or more and 60 seconds or less:

$$A=0.015T-7.6\ (T\geq 507^\circ\ C.),$$

$$A=0\ (T<507^\circ\ C.),$$

$$B=0.0063T-2.8\ (T\geq 445^\circ\ C.),$$

$$B=0\ (T<445^\circ\ C.),$$

$$[Si]+A\times[Cr]\leq B,$$

where [Si]: Si content of the steel by mass %, and [Cr]: Cr content of the steel by mass %.

[3] The method for manufacturing a high strength galvanized steel sheet excellent in terms of coating adhesiveness according to item [2], wherein an exit temperature T further satisfies the following expression:

$$T\leq -80[Mn]-75[Si]+1030,$$

where [Si]: Si content of the steel by mass %, and [Mn]: Mn content of the steel by mass %.

[4] The method for manufacturing a high strength galvanized steel sheet excellent in terms of coating adhesiveness according to any one of items [1] to [3], wherein the oxidation furnace includes three or more zones in which atmospheres can be individually controlled and which are called oxidation furnace 1, oxidation furnace 2, oxidation furnace 3 and so on in ascending order of distance from the entrance of the furnace, in which the atmospheres of the oxidation furnace 1 and the oxidation furnace 3 have an oxygen concentration of less than 1000 vol.ppm and the balance being $N_2$, CO, $CO_2$, $H_2O$ and inevitable impurities and the atmosphere of the oxidation furnace 2 has an oxygen concentration of 1000 vol.ppm or more and the balance being $N_2$, CO, $CO_2$, $H_2O$ and inevitable impurities.

[5] The method for manufacturing a high strength galvanized steel sheet excellent in terms of coating adhesiveness according to item [4], wherein an exit temperature $T_2$ of the oxidation furnace 2 is (the exit temperature T−50)° C. or higher.

[6] The method for manufacturing a high strength galvanized steel sheet excellent in terms of coating adhesiveness according to item [4] or [5], wherein an exit temperature $T_1$ of the oxidation furnace 1 being (the exit temperature T−350)° C. or higher and lower than (the exit temperature T−250)° C.

[7] The method for manufacturing a high strength galvanized steel sheet excellent in terms of coating adhesiveness according to any one of items [1] to [6], wherein the steel has a chemical composition containing C: 0.01 mass % or more and 0.20 mass % or less, Si: 0.5 mass % or more and 2.0 mass % or less, Mn: 1.0 mass % or more and 3.0 mass % or less, Cr: 0.01 mass % or more and 0.4 mass % or less and the balance being Fe and inevitable impurities.

[8] A high strength galvanized steel sheet excellent in terms of coating adhesiveness manufactured by the method according to any one of items [1], [4], [5], [6], and [7] in which an alloying treatment is not performed, the high strength galvanized steel sheet containing oxides of Si in 0.05 g/m$^2$ or more in terms of Si and/or oxides of Mn in 0.05 g/m$^2$ or more in terms of Mn in the region of the steel sheet within 5 μm from the surface of the steel sheet under the coating layer.

[9] A high strength galvanized steel sheet excellent in terms of coating adhesiveness manufactured by the method according to any one of items [2] to [7] in which an alloying treatment is performed, the high strength galvanized steel sheet containing oxides of Si in 0.05 g/m$^2$ or more in terms of Si and/or oxides of Mn in 0.05 g/m$^2$ or more in terms of Mn in a coating layer and further containing oxides of Si in 0.01 g/m$^2$ or less in terms of Si and/or oxides of Mn in 0.01 g/m$^2$ or less in terms Mn in the region of the steel sheet within 5 μm from the surface of the steel sheet under the coating layer.

"High strength" means that a tensile strength TS is 440 MPa or more. In addition, high strength galvanized steel sheets include both of a cold-rolled steel sheet and a hot-rolled steel sheet. In addition, "a galvanized steel sheet" collectively means a steel sheet coated with zinc thereon by a plating treatment method regardless of whether or not the steel sheet is subjected to an alloying treatment. That is to say, galvanized steel sheets include both a galvanized steel sheet not subjected to an alloying treatment and a galvannealed steel sheet subjected to an alloying treatment, unless otherwise noted.

A high strength galvanized steel sheet excellent in terms of coating adhesiveness made from a base material that is a high strength steel sheet containing Si, Mn, and Cr is achieved. In addition, in the case of a high strength galvanized steel sheet subjected to an alloying treatment, the high strength galvanized steel sheet is also excellent in terms of corrosion resistance and fatigue resistance.

DETAILED DESCRIPTION

Our methods and steel sheets will be specifically explained hereafter.

First, an oxidation treatment performed prior to an annealing process will be explained. It is effective to add, for example, Si and Mn to steel as described above to increase the strength of a steel sheet. However, in the case of a steel sheet which contains these chemical elements, the oxides of Si and Mn are formed on the surface of the steel sheet in an annealing process performed prior to a galvanizing treatment, and it is difficult to achieve good zinc coatability in the case where the oxides of Si and Mn are present on the surface of the steel sheet.

We found that coating adhesiveness can be increased by controlling the conditions of annealing performed prior to a galvanizing treatment so that Si and Mn are oxidized inside a steel sheet, because the concentration of the oxides on the surface of the steel sheet is prevented, which results in an increase in zinc coatability, and which further results in an increase in the reactivity between the coating layer and the steel sheet.

We also found that, to prevent the concentration of the oxides of Si and Mn on the surface of a steel sheet by oxidizing Si and Mn inside a steel sheet, it is effective to perform an oxidation treatment in an oxidation furnace prior to an annealing process and thereafter perform reduction annealing, galvanizing and, as needed, an alloying treatment, and that it is further necessary to obtain a certain amount or more of iron oxide in the oxidation treatment. However, since, in the case of steel which contains Cr in addition to Si, oxidation is suppressed by the contained Si and Cr in the oxidation treatment described above, it is difficult to obtain a necessary amount of oxide. In particular, since, in the case of steel which contains Si and Cr in combination, an oxidation suppressing effect is synergistically realized, it is more difficult to obtain a necessary amount of oxide. Therefore, consideration was given to performing an appropriate oxidation treatment to obtain a necessary amount of oxide, in which an end-point (exit) temperature in an oxidation furnace is specified depending on the contents of Si and Cr.

Figure 1:
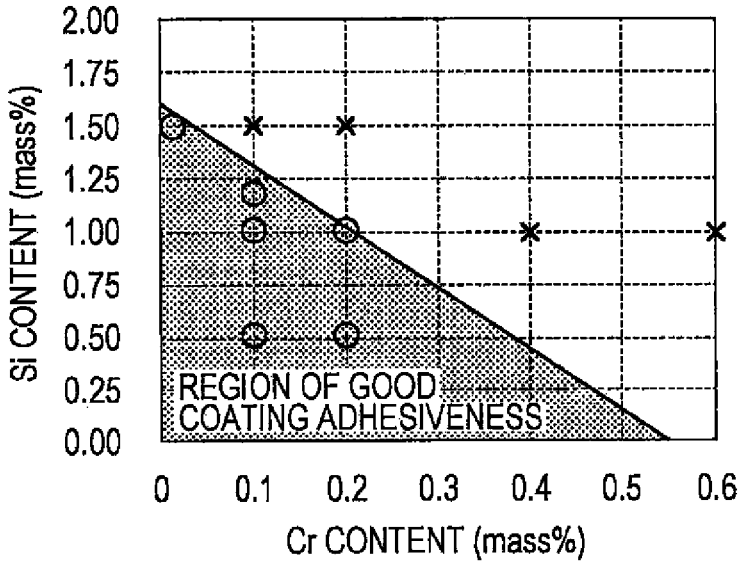
FIG. 1 is a diagram illustrating the relationship among Si content, Cr content and coating adhesiveness.

Using steels which had various contents of Si and Cr, investigations were conducted regarding a region in which good coating adhesiveness was achieved for each oxidation temperature in an oxidation furnace. The results for an oxidation temperature at 700° C. are illustrated in FIG. 1. In FIG. 1, a case of good coating adhesiveness is represented by ○, and a case of poor coating adhesiveness is represented by x. The judgment criteria were the same as those used in Examples described below. FIG. 1 indicates that it is difficult to achieve good coating adhesiveness in the case where the Si content and the Cr content of steel are large. Moreover, regions in which good coating adhesiveness was achieved for other oxidation temperatures were similarly obtained, and the regions were expressed by expression (1) below:

$$[Si]+A\times[Cr]\leq B, \quad (1)$$

where [Si]: Si content of the steel by mass %, and [Cr]: Cr content of the steel by mass %.

Since coefficients A and B vary depending on an oxidation temperature, the relationship among the coefficients A and B and an oxidation temperature was investigated and the expressions (2) through (5) were derived.

$$A=0.015T-7.6\ (T\geq 507^\circ\ C.) \quad (2)$$

$$A=0\ (T<507^\circ\ C.) \quad (3)$$

$$B=0.0063T-2.8\ (T\geq 445^\circ\ C.) \quad (4)$$

$$B=0\ (T<445^\circ\ C.) \quad (5)$$

As described above, good coating adhesiveness is achieved in the case of a high strength steel sheet which contains Si, Mn, and Cr by increasing a temperature up to a temperature which satisfies expressions (1) through (5) in an oxidation furnace prior to an annealing process, that is to say, by controlling an exit temperature of an oxidation furnace to be T.

Coefficient A in the expression (1) represents the slope of the boundary line of a region in which good coating adhesiveness is achieved as illustrated in FIG. 1 and indicates that a decrease in coating adhesiveness due to the addition of Cr is significant in the case where the exit temperature T of an oxidation furnace is high, that is, in the case of a steel sheet which is difficult to oxidize due to its high Si content. This is because, as described above, it is more difficult to obtain a necessary amount of oxide, since an oxidation suppressing effect is synergistically realized in the case of steel which contains Si and Cr in combination. In addition, the coefficient B represents the intercept of the boundary line of a region in which good coating adhesiveness is achieved as illustrated in FIG. 1 and represents the limit of the Si content of a steel sheet which does not contain Cr at an oxidation temperature of T.

As described above, good coating adhesiveness is achieved by obtaining a sufficient amount of oxide with a high oxidation temperature T. However, it is preferable that a temperature T at which an oxidation treatment is performed as described above be 850° C. or lower, because, in the case where excessive oxidation occurs, Fe oxide is peeled off in a furnace in a reducing atmosphere in the next reduction annealing process, which results in the occurrence of pick-up.

Fe oxide which is formed in an oxidation furnace is reduced in the following reduction annealing process. Si and Mn which are contained in steel are oxidized inside a steel sheet and less likely to be concentrated on the surface of the steel sheet. Therefore, in the case where Si and Mn are contained in steel in a large amount, the amount of internal oxides formed in reduction annealing process becomes large. However, we found that, in the case where an excessive amount of internal oxides are formed, there is a phenomenon in which the crystal grains of the base steel are taken into the coating layer through the internal oxides formed at the grain boundaries when a galvanizing treatment is performed and then an alloying treatment is performed.

Moreover, it was found that there is a decrease in corrosion resistance in the case where the crystal grains of the base steel are taken into the coating layer. This is thought to be because a sacrificial corrosion effect is not sufficiently realized, since there is a decrease in the relative amount of zinc which is a main chemical element due to taking in of the base steel into the coating layer. Therefore, it is necessary that an oxidation treatment be performed in an oxidation furnace under such conditions that the crystal grains of the base steel are not taken into the coating layer. Therefore, using steels which had various contents of Si and Mn, investigations were conducted regarding the exit temperature of an oxidation furnace at which the crystal grains of the base steel are not taken into the coating layer.

Figure 2:
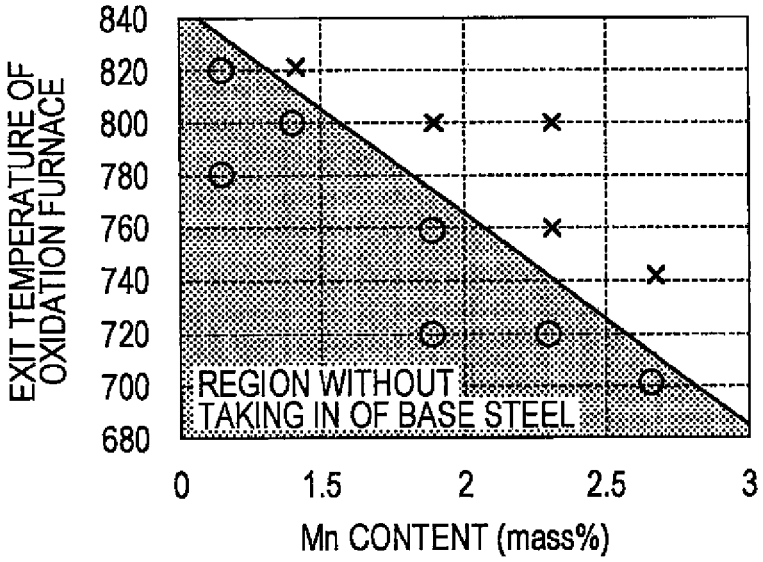
FIG. 2 is a diagram illustrating the relationship among Mn content, the exit temperature of an oxidation furnace and taking in of base steel.

FIG. 2 illustrates cases with or without occurrence of taking in of the crystal grains of the base steel in relation to the Mn content and the exit temperature of an oxidation furnace in the case of steel which contains Si in an amount of 1.5%. In FIG. 2, a case without taking in of the base steel is represented by ○, and a case with taking in of the base steel is represented by x. Criteria for judgment were the same as those used in Examples described below. FIG. 2 indicates that taking in of the base steel tends to occur in the case of steel which has a large Mn content. Moreover, from the results of the investigations conducted in the same manner as described above using steel which had a constant Mn content and various Si contents, it was found that taking in of the base steel tends to occur in the case of steel which has a large Si content.

As a result, it was found that X=−80, when the boundary between a region in which taking in of the base steel does not occur and a region in which taking in of the base steel occurs is represented in the form of the expression (the exit temperature of an oxidation furnace)=X×[Mn]+Y, where [Mn] represents the Mn content in steel by mass %. In addition, Y is a value which varies depending on the Si content, and from the results of the investigations regarding the relationship between Y and the Si content, it was also found that Y=−75×[Si]+1030. From these results, it was found that the exit temperature of an oxidation furnace at which a base steel is not taken into a coating layer can be represented by the expression (6) below:

$$T \leq -80[Mn]-75[Si]+1030, \quad (6)$$

where T represents the exit temperature of an oxidation furnace, [Mn] represents the Mn content of the steel by mass %, and [Si] represents the Si content of the steel by mass %.

As described above, good corrosion resistance is achieved without the occurrence of taking in of the crystal grains of the base steel into the coating layer by increasing the temperature in an oxidation furnace up to a temperature which satisfies the expression (6), that is to say, by controlling the exit temperature of an oxidation furnace to be T.

Further, there is no particular limitation on a method of corrosion test for evaluation of corrosion resistance, and, for example, an existing test which has been used for a long time such as an exposure test, a neutral salt spray corrosion test, and a combined cyclic corrosion test in which repeated drying and wetting and temperature change are added to a neutral salt spray corrosion test may be used. There are many conditions for a combined cyclic corrosion test, for example, a test method according to JASO M-609-91 or a corrosion test according to SAE-J2334 produced by the Society of Automotive Engineers may be used.

As described above, good coating adhesiveness is achieved and good corrosion resistance is achieved by controlling oxidation temperature T.

Next, the relationship between the atmosphere of an oxidation furnace and coating adhesiveness will be described In the case where reduction annealing is performed after an oxidation treatment has been performed, iron oxide which has been formed in the oxidation treatment is reduced in a reduction annealing process, and the base steel sheet is covered with the reduced iron. The reduced iron formed at this time is significantly effective in achieving good coating adhesiveness because it has small content ratio of chemical elements which decrease coating adhesiveness such as Si. Good coating adhesiveness is achieved in the case where the coverage factor of the reduced iron formed after reduction annealing has been performed is large, preferably in the case where the reduced iron is present on 40% or more of the surface of the base steel sheet. Further, the coverage factor of the reduced iron of a steel sheet, which is in the state before being subjected to a galvanizing treatment, can be measured by observing a backscattered electron image which is taken using a scanning electron microscope (SEM). Since a chemical element having a larger atomic number tends to look whiter on a backscattered electron image, a part which is covered with the reduced iron looks whiter. In addition, a part which is not covered with the reduced iron looks darker because oxides of, for example, Si are formed on the surface. Therefore, the coverage factor of the reduced iron can be derived by obtaining the area ratio of the white part using image processing.

We found that it is important to control the kinds of oxides formed on the surface of the base steel sheet when an oxidation treatment is performed to increase the coverage factor of reduced iron. The formed iron oxide is mainly wustite (FeO). Moreover, at the same time, oxides containing Si are formed in the case of a high strength galvanized steel sheet which contains Si in an amount of 0.1% or more. These oxides containing Si are mainly $SiO_2$ and/or $(Fe,Mn)_2SiO_4$ and formed mainly at the interface between the iron oxide and the base steel sheet. Although the mechanism has not been clarified, we found that the coverage factor of the reduced iron is large in the case where $(Fe,Mn)_2SiO_4$ is formed after an oxidation treatment has been performed. Since the coverage factor of the reduced iron is small in the case where only $SiO_2$ is formed, the sufficient coverage factor to provide satisfactory coating adhesiveness is not achieved. In addition, it was also found that, since, as long as $(Fe,Mn)_2SiO_4$ is formed, the coverage factor of the reduced iron is large even if $SiO_2$ is present at the same time, a satisfactory coverage factor is achieved. Further, there is no particular limitation on a method of judging the state of the presence of these oxides, and infrared (IR) spectroscopy is effective. The state of the presence of the oxides can be judged by observing absorption peaks found in the vicinity of 1245 $cm^{-1}$, which is characteristic of $SiO_2$, and in the vicinity of 980 $cm^{-1}$, which is characteristic of $(Fe,Mn)_2SiO_4$.

As described above, it is important in forming reduced iron having a large coverage factor after reduction annealing has been performed to form $(Fe,Mn)_2SiO_4$ after an oxidation treatment has been performed. Therefore, investigations were subsequently conducted regarding a method of forming $(Fe,Mn)_2SiO_4$ after an oxidation treatment has been performed. As a result, we found that it is effective to heat a steel sheet in an atmosphere having a low oxygen concentration in the final stage of an oxidation treatment process. In addition, it is preferable that the oxygen concentration at that time be less than 1000 vol.ppm (hereinafter, referred as ppm), and $(Fe,Mn)_2SiO_4$ is not formed in the case where oxygen concentration is more than 1000 ppm, which results in a decrease in the coverage factor of the reduced iron. In addition, it is preferable to heat a steel sheet in an atmosphere having a high oxygen concentration to promote the oxidation reaction of steel before heating in an atmosphere having a low oxygen concentration is performed at the final stage. Specifically, a sufficient amount of iron oxide is achieved by heating a steel sheet in an atmosphere having an oxygen concentration of 1000 ppm or more because the oxidation reaction of steel is promoted. In addition, it is difficult to achieve a sufficient amount of iron oxide in the case where the oxygen concentration is less than 1000 ppm because it is difficult to stably perform an oxidation treatment.

Moreover, it is possible to form a uniform layer of iron oxide by performing the earlier stage of an oxidation treatment in an atmosphere having a low oxygen concentration. It is thought that, since a thin, compact and uniform layer of iron oxide, which becomes a core of iron oxide, is formed on the surface of a steel sheet by performing an oxidation treatment at a comparatively low rate of oxidation in an atmosphere having a low oxygen concentration at the earlier stage of oxidation, it is possible to form a uniform layer of iron oxide even if an oxidation treatment is consequently performed at a comparatively high rate of oxidation in an atmosphere having a high oxygen concentration.

Further, although it is preferable that the oxygen concentration of the atmosphere of an oxidation furnace be controlled as described above, it is possible to realize a sufficient effect as long as the oxygen concentration is controlled to be within the specified range even if, for example, $N_2$, CO, $CO_2$, $H_2O$ and inevitable impurities are included in the atmosphere.

Summarizing the above, it is preferable that the oxidation furnace consist of three or more zones in which the atmospheres can be individually controlled and which are called oxidetion furnace 1, oxidation furnace 2, oxidation furnace 3 and so on in ascending order of distance from the entrance of the furnace, in which the atmospheres of the oxidation furnaces 1 and 3 have an oxygen concentration of less than 1000 ppm and the balance being $N_2$, CO, $CO_2$, $H_2O$ and inevitable impurities and the atmosphere of the oxidation furnace 2 has an oxygen concentration of 1000 ppm or more and the balance being $N_2$, CO, $CO_2$, $H_2O$ and inevitable impurities.

Next, the exit temperature of each oxidation furnace will be explained.

It is necessary that, as described above, the temperature of the oxidation furnace 3, which is the final stage of an oxidation treatment process, be a temperature which satisfies expressions (1) to (5), that is, the exit temperature T.

It is important to perform oxidation of iron in a wide temperature range in the oxidation furnace 2 because the oxidation furnace 2 is a zone in which the oxidation reaction of iron occurs practically the most intensively in an atmosphere having a high oxygen concentration. Specifically, it is preferable that the exit temperature $T_2$ of the oxidation furnace 2 be (the exit temperature T−50)° C. or higher. For the same reason, it is preferable that the entrance temperature of the oxidation furnace 2, that is, the exit temperature $T_1$ of the oxidation furnace 1, be lower than (the exit temperature T−250)° C. There is a case where it is difficult to achieve a necessary amount of iron oxide in the oxidation furnace 2 in the case where the conditions described above are not satisfied.

In addition, it is preferable that the exit temperature $T_1$ of the oxidation furnace 1 be (the exit temperature T−350)° C. or higher. It is difficult to realize a sufficient effect of forming a thin and uniform layer of iron oxide in the case where $T_1$ is lower than (the exit temperature T−350)° C.

It is necessary that a heating furnace used for an oxidation treatment consist of three or more zones in which the atmospheres can be individually controlled to allow the atmospheres to be controlled as described above. In the case where the oxidation furnace consists of three zones, it is appropriate that the atmosphere of each zone is controlled as described above. In the case where the oxidation furnace consists of four or more zones, adjacent zones may be considered as one oxidation furnace by controlling the atmospheres of these zones in a similar way. In addition, although there is no particular limitation on the kind of a heating furnace, it is ideal to use a direct-fired heating furnace which uses direct fire burners. A direct fire burner is used to heat a steel sheet in a manner such that burner flames produced by burning the mixture of a fuel such as a coke oven gas (COG) which is a by-product gas from a steel plant and air come in direct contact with the surface of the steel sheet. Since the rate of temperature increase of a steel sheet is larger with a direct fire burner than with heating of a radiant type, there are advantages in that the length of a heating furnace is made shorter and the line speed is increased. Moreover, when a direct fire burner is used, it is possible to promote oxidation of a steel sheet by setting the air ratio to be 0.95 or more to increase the ratio of the amount of air to the amount of fuel because unreduced oxygen is left in the flames and used in the oxidation. Therefore, it becomes possible to control the concentration of oxygen in the atmosphere by adjusting the air ratio. In addition, COG, liquefied natural gas (LNG) and the like may be used as the fuel for a direct fire burner.

After performing an oxidation treatment on a steel sheet as described above, reduction annealing is performed. Although there is no limitation on the conditions of a reduction annealing, it is preferable that an atmospheric gas fed into an annealing furnace generally contain 1 vol. % or more and 20 vol. % or less of $H_2$ and the balance being $N_2$ and inevitable impurities. The amount of $H_2$ is not enough to reduce Fe oxide on the surface of the steel sheet in the case where the concentration of $H_2$ in the atmosphere is less than 1 vol. %, and excessive $H_2$ is useless because reduction reaction of Fe oxide becomes saturated in the case where the concentration of $H_2$ in the atmosphere is more than 20 vol. %. In addition, since oxidation by the oxygen of $H_2O$ in a furnace becomes remarkable in the case where a dewpoint is higher than −25° C., which results in the excessive internal oxidation of Si, it is preferable that the dewpoint be −25° C. or lower. As described above, the atmosphere of the annealing furnace becomes a reducing atmosphere for Fe and the reduction of iron oxide formed in an oxidation treatment occurs. At the same time, some oxygen which has been separated from Fe by reduction diffuses inside a steel sheet and reacts with Si and Mn, which results in the internal oxidation of Si and Mn. Since Si and Mn are oxidized inside a steel sheet, there is a decrease in the amount of Si oxide and Mn oxide on the outermost surface of the steel sheet that is to be contact with molten zinc, which results in an increase in coating adhesiveness.

From the view point of controlling material quality, it is preferable that reduction annealing be performed under the conditions that the temperature of a steel sheet is 700° C. or higher and 900° C. or lower and a soaking time is 10 seconds or more and 300 seconds or less.

After reduction annealing has been performed, the annealed steel sheet is cooled down to a temperature of 440° C. or higher and 550° C. or lower, and then subjected to a galvanizing treatment. For example, a galvanizing treatment is performed under the conditions that the temperature of the steel sheet is 440° C. or higher and 550° C. or lower by dipping the steel sheet into a plating bath in which the amount of dissolved Al is 0.12 mass % or more and 0.22 mass % or less in the case where an alloying treatment for a galvanizing layer is not performed, or in which the amount of dissolved Al is 0.08 mass % or more and 0.18 mass % or less in the case where an alloying treatment is performed after a galvanizing treatment. Coating weight is controlled by, for example, a gas wiping method. It is appropriate that the temperature of the galvanizing plating bath is 440° C. or higher and 500° C. or lower and, that in the case where an alloying treatment is further performed, the steel sheet is heated at a temperature of 460° C. or higher and 600° C. or lower for an alloying treatment time of 10 seconds or more and 60 seconds or less. There is a decrease in coating adhesiveness in the case where the heating temperature is higher than 600° C., and there is no progress in alloying in the case where the heating temperature is lower than 460° C.

In the case where an alloying treatment is performed, an alloying degree (the Fe % in the coating layer) is set to be 7 mass % or more and 15 mass % or less. There is a decrease in surface appearance due to uneven alloying and a decrease in slide performance due to the growth of a so-called "ζ phase" in the case where the alloying degree is less than 7 mass %. There is a decrease in coating adhesiveness due to formation of a large amount of hard and brittle Γ phase in the case where the alloying degree is more than 15 mass %.

As described above, the high strength galvanized steel sheet can be manufactured.

The high strength galvanized steel sheet manufactured by the method described above will be explained hereafter. Hereinafter, the content of each chemical element of the chemical composition of steel and the content of each chemical element of the chemical composition of a coating layer are all expressed in units of "mass %" and represented simply by "%," unless otherwise noted.

First, the ideal chemical composition of steel will be explained.

C: 0.01% or more and 0.20% or less

C makes formability easier to increase by promoting formation of a martensite phase in the microstructure of steel. It is preferable that the C content be 0.01% or more to realize this effect. On the other hand, there is a decrease in weldability in the case where the C content is more than 0.20%. Therefore, the C content is 0.01% or more and 0.20% or less.

Si: 0.5% or more and 2.0% or less

Si is a chemical element effective in achieving good material quality by increasing the strength of steel. It is not economically preferable that the Si content be less than 0.5% because expensive alloying chemical elements are necessary to achieve sufficiently high strength. On the other hand, there may be an operational problem in the case where the Si content is more than 2.0% because the exit temperature of an oxidation furnace, which satisfies expressions (1) through (5), becomes high. Therefore the Si content is 0.5% or more and 2.0% or less.

Mn: 1.0% or more and 3.0% or less

Mn is a chemical element effective in increasing the strength of steel. It is preferable that the Mn content be 1.0% or more to achieve sufficient mechanical properties and strength. In the case where the Mn content is more than 3.0%, there is a case where it is difficult to achieve good weldability and the balance of strength and ductility, and excessive internal oxidation occurs. Therefore, the Mn content is 1.0% or more and 3.0% or less.

Cr: 0.01% or more and 0.4% or less

There may be a decrease in the balance of strength and ductility in the case where the Cr content is less than 0.01% because it is difficult to achieve good hardenability. On the other hand, there may be an operational problem in the case where the Si content is more than 0.4% because, as is the case with Si, the exit temperature of an oxidation furnace, which satisfies expressions (1) through (5), becomes high. Therefore, the Cr content is 0.01% or more and 0.4% or less.

Further, one or more chemical elements selected from among Al: 0.01% or more and 0.1% or less, B: 0.001% or more and 0.005% or less, Nb: 0.005% or more and 0.05% or less, Ti: 0.005% or more and 0.05% or less, Mo: 0.05% or more and 1.0% or less, Cu: 0.05% or more and 1.0% or less and Ni: 0.05% or more and 1.0% or less may be added as needed to control the balance of strength and ductility.

The reason for the limitations on the appropriate contents in the case where these chemical elements are added will be explained hereafter.

Since Al is the easiest to oxidize on the basis of thermodynamics, Al is effective in promoting oxidation of Si and Mn by being oxidized before Si and Mn. This effect is realized in the case where the Al content is 0.01% or more. On the other hand, there is an increase in cost in the case where the Al content is more than 0.1%.

It is difficult to realize a quenching effect in the case where the B content is less than 0.001%, and there is a decrease in coating adhesiveness in the case where the B content is more than 0.005%

It is difficult to realize an effect of strength control and an effect of increasing coating adhesiveness when Nb is added in combination with Mo in the case where the Nb content is less than 0.005%, and there is an increase in cost in the case where the Nb content is more than 0.05%.

It is difficult to realize an effect of strength control in the case where the Ti content is less than 0.005%, and there is a decrease in coating adhesiveness in the case where the Ti content is more than 0.05%.

It is difficult to realize an effect of strength control and an effect of increasing coating adhesiveness when Mo is added in combination with Nb or Ni and Cu in the case where the Mo content is less than 0.05%, and there is an increase in cost in the case where the Mo content is more than 1.0%.

It is difficult to realize an effect of promoting the formation of retained γ phase and an effect of increasing coating adhesiveness when Cu is added in combination with Ni and Mo in the case where the Cu content is less than 0.05%, and there is an increase in cost in the case where the Cu content is more than 1.0%.

It is difficult to realize an effect of promoting formation of retained γ phase and an effect of increasing coating adhesiveness when Ni is added in combination with Cu and Mo in the case where the Ni content is less than 0.05%, and there is an increase in cost in the case where the Ni content is more than 1.0%.

The remainder of the chemical composition other than chemical elements described above consists of Fe and inevitable impurities.

Next, internal oxides of Si and Mn formed after reduction annealing and galvanizing have been performed, and after an alloying treatment has been performed as needed, following an oxidation treatment will be explained.

A galvanized steel sheet is usually manufactured by annealing a material steel sheet in a reducing atmosphere in a continuous annealing line, dipping the annealed steel sheet into a galvanizing bath to galvanize the steel sheet, pulling up the steel sheet from the galvanizing bath and controlling a coating weight with a gas wiping nozzle and, further, by performing an alloying treatment on the coating layer in an alloying heating furnace. To increase the strength of a galvanizing steel sheet it is effective to add, for example, Si and Mn to steel as described above. However, it is difficult to achieve good coating adhesiveness because the oxides of added Si and Mn are formed on the surface of the steel sheet in an annealing process. To solve this problem, the concentration of oxides of Si and Mn on the surface of the steel sheet is prevented by performing an oxidation treatment prior to reduction annealing under the oxidation conditions depending on the contents of Si and Cr so that the oxidation of Si and Mn may occur in the steel sheet. As a result, there is an increase in zinc coatability and, further, there is an increase in the reactivity of the steel sheet with molten zinc, which results in an increase in coating adhesiveness. Although the internal oxides of Si or/and Mn formed when reduction annealing is performed stay in the surface layer of the steel sheet under the coating layer in the case of a galvanized steel sheet which is not subjected to an alloying treatment, the internal oxides diffuse in the coating layer in the case of a galvanized steel sheet which is subjected to an alloying treatment because alloying reaction of Fe—Zn progresses from the interface between the coating layer and the steel sheet. Therefore, it is believed that coating adhesiveness is affected by the amount of the internal oxides in the surface layer of the steel sheet under the coating layer in the case of a galvanized steel sheet which is not subjected to an alloying treatment, and by the amount of the internal oxides in the coating layer in the case of a galvanized steel sheet which is subjected to an alloying treatment.

We focused on the oxides present in the surface layer of the steel sheet under the coating layer and in the coating layer, regarding the relationship between coating adhesiveness and the amount of Si and Mn present in the form of oxides in both layers. As a result, we found that coating adhesiveness is good in the case where Si and Mn in the form of oxides are present in an amount of 0.05 g/m$^2$ or more each in the region of the steel sheet within 5 μm from the surface layer of the steel sheet under the coating layer in the case of a galvanized steel sheet which is not subjected to an alloying treatment, and in the coating layer in the case of a galvanizing steel sheet which is subjected to an alloying treatment. It is thought that, in the case where the amount of Si and Mn in the form of oxides is less than 0.05 g/m$^2$ each, good coating adhesiveness is not achieved because the internal oxidation of Si and Mn does not occur and there is the concentration of oxides on the surface of the steel sheet before being subjected to a galvanizing treatment. In addition, it is thought that, in the case where only one of Si and Mn satisfies our parameters, the internal oxidation of the one chemical element occurs and the concentration of the other chemical element occurs on the surface of the steel sheet, which results in a negative effect on zinc coatability and coating adhesiveness. Therefore, it is necessary that the internal oxidation of both of Si and Mn occur. Therefore, it is the characteristic and important requirement that both of Si and Mn in the form of oxides are present in an amount of 0.05 g/m$^2$ or more ecah in the regions described above. Although there is no particular limitations on the upper limit of the amounts of Si and Mn in the form of oxides present in the region described above, it is preferable that the upper limit be 1.0 g/m$^2$ or less each because there is a concern that taking in of the crystal grains of the base steel may occur through the oxides in the case where the amounts are 1.0 g/m$^2$ or more respectively.

Moreover, we found that there is a close relationship between fatigue resistance and the amount of Si and Mn in the form of oxides present in the surface layer of a steel sheet under the coating layer in the case of a galvanized steel sheet which is subjected to an alloying treatment. We found that there is an increase in fatigue resistance in the case where the amounts of Si and Mn in the form of oxides present in the region of the steel sheet within 5 μm from the surface of the steel sheet under the coating layer, are respectively 0.01 g/m$^2$ or less. The mechanism in which fatigue resistance is increased by controlling the amount of oxides in the surface layer of a steel sheet under the coating layer of a galvanized steel sheet which is subjected to an alloying treatment is not clear. However, we believe that the oxide present in the region becomes the origin of a crack which is caused by fatigue. We believe that, in the case where this kind of oxide which is the origin of crack is present, a crack tends to occur when a tensile stress is applied because the coating layer of the galvanized steel sheet which is subjected to an alloying treatment is hard and brittle. We also believe that this crack progresses from the surface of the coating layer to the interface of the coating layer and the surface of the steel sheet and, that in the case where an oxide is present in the surface layer of the steel sheet under the coating layer, the crack further progresses through the oxide serving as an origin. On the other hand, we believe that fatigue resistance is increased in the case where the requirement that the amount of oxides present in the surface layer of the steel sheet, be 0.01 g/m$^2$ or less because a crack which occurs in the coating layer does not progress into the inside of the steel sheet.

Although there is no particular limitation on a manufacturing method of realizing the state of presence of the oxides described above, it is possible to realize that by controlling the temperature of a steel sheet and a treatment time in an alloying treatment. In the case where the temperature of an alloying treatment is low or a treatment time is short, the progress of the alloying reaction of Fe—Zn from the interface of the coating layer and the steel sheet is insufficient which results in an increase in the amount of oxides retained in the surface layer of the steel sheet. Therefore, it is necessary that sufficient temperature of an alloying treatment and/or a treating time be secured to achieve a satisfactory alloying reaction of Fe—Zn. It is preferable that the heating temperature be 460° C. or higher and 600° C. or lower and the treating time be 10 seconds or more and 60 seconds or less as described above.

In addition, in the case of a galvanized steel sheet which is not subjected to an alloying treatment, good fatigue resistance is achieved in the case where the amounts of Si and Mn in the form of oxides present in the region of the steel sheet within 5 μm from the surface of the steel sheet under the coating layer, are respectively 0.01 g/m$^2$ or more. Since the coating layer of a galvanized steel sheet is not alloyed and almost consists of Zn, it has better ductility than the coating layer of a galvannealed steel sheet. Therefore, we believe that, since crack does not occur even when a tensile stress is applied, the influence of oxides which are present in the surface layer of the steel sheet under the coating layer does not emerge.

Example 1

The steels having the chemical compositions given in Table 1 were smelted and the obtained slabs were hot-rolled, pickled and cold-rolled into cold-rolled steel sheets having a thickness of 1.2 mm.

TABLE 1

(mass %)

| Steel Code | C | Si | Mn | Cr | P | S |
|---|---|---|---|---|---|---|
| A | 0.03 | 0.5 | 2.0 | 0.1 | 0.01 | 0.001 |
| B | 0.05 | 1.0 | 2.0 | 0.1 | 0.01 | 0.001 |
| C | 0.07 | 1.2 | 1.9 | 0.1 | 0.01 | 0.001 |
| D | 0.08 | 1.5 | 1.2 | 0.2 | 0.01 | 0.001 |

TABLE 1-continued

| Steel Code | C | Si | Mn | Cr | P | (mass %) S |
|---|---|---|---|---|---|---|
| E | 0.09 | 1.5 | 2.3 | 0.2 | 0.01 | 0.001 |
| F | 0.12 | 1.5 | 2.5 | 0.2 | 0.01 | 0.001 |
| G | 0.09 | 1.5 | 1.4 | 0.02 | 0.01 | 0.001 |
| H | 0.08 | 1.5 | 2.7 | 0.02 | 0.01 | 0.001 |
| I | 0.11 | 1.5 | 2.7 | 0.02 | 0.01 | 0.001 |
| J | 0.09 | 1.0 | 1.8 | 0.6 | 0.01 | 0.001 |
| K | 0.11 | 2.3 | 1.9 | 0.2 | 0.01 | 0.001 |
| L | 0.12 | 1.2 | 3.2 | 0.1 | 0.01 | 0.001 |

Then, the cold-rolled steel sheets described above were heated using a CGL consisting of an oxidation furnace of a DFF type at various exit temperatures of the oxidation furnace. COG was used as a fuel of the direct fire burner, and the concentration of oxygen of an atmosphere was adjusted to 10000 ppm by controlling an air ratio. The concentration of oxygen of the whole oxidation furnace was adjusted. The temperature of the steel sheet at the exit temperature of the DFF was measured using a radiation thermometer. Then, reduction annealing was performed in the reduction zone under the conditions that the temperature was 850° C. and the treating time was 20 seconds, hot dipping was performed in a galvanizing bath under the conditions that the Al content was adjusted to 0.19% and the temperature was 460° C., and then a coating weight was adjusted to 50 g/m$^2$ using gas wiping.

As for the galvanized steel sheets obtained as described above, the coating weight and the amounts of Si and Mn contained in the oxides which were present in the region of the steel sheet within 5 μm from the surface of the steel sheet under the coating layer were determined and surface appearance and coating adhesiveness were evaluated. Moreover, tensile properties and fatigue resistance were investigated.

The methods for measurement and evaluation will be explained hereafter.

The obtained coating layer was dissolved in a hydrochloric acid solution containing an inhibiter, and then the layer within 5 μm from the surface of the steel sheet was dissolved using constant-current electrolysis in a non-aqueous solution. The obtained residue of the oxides was filtered through a nuclepore filter having a pore size of 50 nm, and the oxides trapped by the filter were subjected to alkali fusion and to ICP analysis to determine the amount of Si and Mn.

A case where there was no appearance defect such as bare spots was evaluated as a case where surface appearance was good (represented by ○), and a case where there was appearance defects was evaluated as a case where surface appearance was poor (represented by x).

In the case of a galvanized a steel sheet which is not subjected to an alloying treatment, coating adhesiveness was evaluated by performing a ball impact test, a tape peeling test at the impacted part and a visual test regarding whether or not there was the peeling of the coating layer.

○: without peeling of the coating layer x: with peeling of the coating layer

A tensile test was carried out using a JIS No. 5 tensile test piece in accordance with JIS Z 2241 in which a tensile direction was the rolling direction.

A fatigue test was carried out under the condition of a stress ratio R of 0.05, a fatigue limit (FL) for a cycle $10^7$ was determined, an endurance ratio (FL/TS) was derived, and a case where an endurance ratio was 0.60 or more was evaluated as the case where fatigue resistance was good. A stress ratio R is a value which is defined by (the minimum repeated stress)/(the maximum repeated stress).

The results obtained as described above are given in Table 2 in combination with the manufacturing conditions.

TABLE 22

| No. | Steel Grade | Exit Temperature of Oxidation Furnace T(° C.) | A*1 | B*2 | Judgment*3 | Coating Surface Appearance | Amount of Si in Oxides within 5 μm from Surface of Steel Sheet (g/m$^2$) | Amount of Mn in Oxides within 5 μm from Surface of Steel Sheet (g/m$^2$) | Coating Adhesiveness | Tensile Strength (MPa) | Tensile Fatigue Limit (MPa) | Endurance Ratio | |
|---|---|---|---|---|---|---|---|---|---|---|---|---|---|
| 1 | A | 500 | 0.0 | 0.4 | X | ○ | 0.022 | 0.059 | X | 458 | 355 | 0.78 | Comparative Example |
| 2 | A | 550 | 0.7 | 0.7 | ○ | ○ | 0.057 | 0.085 | ○ | 460 | 345 | 0.75 | Example |
| 3 | A | 600 | 1.4 | 1.0 | ○ | ○ | 0.080 | 0.106 | ○ | 477 | 380 | 0.80 | Example |
| 4 | B | 600 | 1.4 | 1.0 | X | ○ | 0.043 | 0.036 | X | 645 | 480 | 0.74 | Comparative Example |
| 5 | B | 650 | 2.2 | 1.3 | ○ | ○ | 0.068 | 0.075 | ○ | 632 | 500 | 0.79 | Example |
| 6 | C | 650 | 2.2 | 1.3 | X | ○ | 0.036 | 0.032 | X | 795 | 565 | 0.71 | Comparative Example |
| 7 | C | 700 | 2.9 | 1.6 | ○ | ○ | 0.062 | 0.056 | ○ | 801 | 570 | 0.71 | Example |
| 8 | D | 800 | 4.4 | 2.2 | X | X | 0.018 | 0.011 | X | 820 | 550 | 0.67 | Comparative Example |
| 9 | D | 850 | 5.2 | 2.6 | ○ | ○ | 0.074 | 0.054 | ○ | 846 | 590 | 0.70 | Example |
| 10 | E | 850 | 5.2 | 2.6 | ○ | ○ | 0.075 | 0.110 | ○ | 1046 | 760 | 0.73 | Example |
| 11 | F | 850 | 5.2 | 2.6 | ○ | ○ | 0.077 | 0.095 | ○ | 1198 | 800 | 0.67 | Example |
| 12 | F | 800 | 4.4 | 2.2 | X | X | 0.025 | 0.038 | X | 1206 | 825 | 0.68 | Comparative Example |
| 13 | G | 750 | 3.7 | 1.9 | ○ | ○ | 0.088 | 0.079 | ○ | 642 | 460 | 0.72 | Example |
| 14 | H | 750 | 3.7 | 1.9 | ○ | ○ | 0.105 | 0.112 | ○ | 1005 | 770 | 0.77 | Example |
| 15 | H | 700 | 2.9 | 1.6 | ○ | ○ | 0.085 | 0.071 | ○ | 994 | 745 | 0.75 | Example |
| 16 | H | 650 | 2.2 | 1.3 | X | ○ | 0.040 | 0.055 | X | 982 | 715 | 0.73 | Comparative Example |
| 17 | I | 700 | 2.9 | 1.6 | ○ | ○ | 0.054 | 0.096 | ○ | 1211 | 800 | 0.66 | Example |
| 18 | J | 700 | 2.9 | 1.6 | X | X | 0.022 | 0.018 | X | 845 | 600 | 0.71 | Comparative Example |

TABLE 22-continued

| No. | Steel Grade | Exit Temperature of Oxidation Furnace T(° C.) | A*1 | B*2 | Judgment*3 | Coating Surface Appearance | Amount of Si in Oxides within 5 μm from Surface of Steel Sheet (g/m$^2$) | Amount of Mn in Oxides within 5 μm from Surface of Steel Sheet (g/m$^2$) | Coating Adhesiveness | Tensile Strength (MPa) | Tensile Fatigue Limit (MPa) | Endurance Ratio | |
|---|---|---|---|---|---|---|---|---|---|---|---|---|---|
| 19 | K | 700 | 2.9 | 1.6 | X | X | 0.041 | 0.021 | X | 1423 | 945 | 0.66 | Comparative Example |
| 20 | L | 700 | 2.9 | 1.6 | ○ | ○ | 0.053 | 0.129 | ○ | 1224 | 825 | 0.67 | Example |

Under lined value is out of range according to the present invention.
*1A = 0.015T − 7.6 (T ≥ 507° C.)
A = 0 (T ≤ 506° C.)
*2B = 0.0063T − 2.8 (T ≥ 445° C.)
B = 0 (T ≤ 444° C.)
*3[Si] + A[Cr] ≤ B: ○
[Si] + A[Cr] > B: X,
where [Si] and [Cr] respectively represent contents (mass %) of Si and Cr in steel.

Table 2 indicates that a galvanized steel sheet which was manufactured by our method (Example) was excellent in terms of coating adhesiveness, surface appearance and fatigue resistance, even though it was high strength steel which contains Si, Mn, and Cr. On the other hand, a galvanized steel sheet which was manufactured by the method which was out of our range (Comparative Example) was poor in terms of one or more of coating adhesiveness and surface appearance.

Example 2

The steels having the chemical compositions given in Table 1 were smelted and the obtained slabs were hot-rolled, pickled and cold-rolled into cold-rolled steel sheets having a thickness of 1.2 mm.

Then, an oxidation treatment and reduction annealing were performed using the same methods as used in Example 1. Moreover, hot dipping was performed in a galvanizing bath under the conditions that the Al content was adjusted to 0.13% and the temperature was 460° C., a coating weight was adjusted to about 50 g/m$^2$ using gas wiping, and then an alloying treatment was performed at the specified temperature given in Table 3 for an alloying treatment time of 20 seconds or more and 30 seconds or less.

As for the galvanized steel sheets obtained as described above, the coating weight and the Fe content of the coating layer were determined. Moreover, the amounts of Si and Mn in the form of oxides which are present in the coating layer and in the region of the steel sheet within 5 μm from the surface of the steel sheet under the coating layer were determined and surface appearance and coating adhesiveness were evaluated. Moreover, tensile properties and fatigue resistance were investigated.

The methods for measurement and evaluation will be explained hereafter.

The obtained coating layer was dissolved in a hydrochloric acid solution containing an inhibiter, a coating weight was determined from the deference between the mass before and after dissolution, and the Fe content ratio in the coating layer was determined from the amount of Fe contained in the hydrochloric acid solution.

To determine the amount of Si and Mn, the zinc coating layer was dissolved using constant-current electrolysis in a non-aqueous solution, and then the layer within 5 μm from the surface of the steel sheet was dissolved using constant-current electrolysis in a non-aqueous solution. Each of the residues of the oxides which were obtained in the respective dissolving processes was filtered through a nuclepore filter having a pore size of 50 nm, and then the oxides trapped by the filter were subjected to alkali fusion and to ICP analysis to determine the amounts of Si and Mn contained in the oxides in the coating layer and in the region of steel sheet within 5 μm from the surface of the steel sheet under the coating layer.

Surface appearance of the galvanized steel sheet after an alloying treatment had been performed was observed using a visual test. A case where there was not unevenness in alloying or a bare spot was represented by ○, and a case where there was unevenness in alloying or a bare spot was represented by x.

As for galvanized steel sheet which was subjected to an alloying treatment, to evaluate coating adhesiveness, Cellotape (registered trademark) was stuck to the galvanized steel sheet, and a peeling amount per unit length was determined from a Zn count number observed using fluorescent X-rays when the stuck tape surface was subjected to a 90 degree bending-unbending test. On the basis of the standard below, a case corresponding to rank 1 was evaluated as good (⊙), a case corresponding to rank 2 or 3 was evaluated as good (○) and a case corresponding to rank 4 or 5 was evaluated as poor (x).

Fluorescent X-rays count number: rank
0 or more and less than 500: 1 (good)
500 or more and less than 1000: 2
1000 or more and less than 2000: 3
2000 or more and less than 3000: 4
3000 or more: 5 (poor)

Tensile properties and fatigue resistance were evaluated using the same methods as used in Example 1.

The results obtained as described above are given in Table 3 in combination with the manufacturing conditions.

TABLE 3

| No. | Steel Grade | Exit Temperature Of Oxidation Furnace T(° C.) | A*1 | B*2 | Judgment*3 | Alloying Temperature (° C.) | Fe Content in Coating Layer (mass %) | Coating Surface Appearance | Amount of Si in Oxides in Coating Layer (g/m$^2$) | Amount Of Mn in Oxides in Coating Layer (g/m$^2$) | Coating Adhesiveness | Amount of Si in Oxides within 5 μm from Surface of Steel Sheet (g/m$^2$) | Amount of Mn in Oxides within 5 μm from Surface of Steel Sheet (g/m$^2$) | Tensile Strength (MPa) | Tensile Fatigue Limit (MPa) | Endurance Ratio | |
|---|---|---|---|---|---|---|---|---|---|---|---|---|---|---|---|---|---|
| 21 | A | 500 | 0.0 | 0.4 | X | 480 | 9.7 | ○ | 0.018 | 0.052 | X | 0.005 | 0.006 | 468 | 360 | 0.77 | Comparative Example |
| 22 | A | 550 | 0.7 | 0.7 | ○ | 480 | 9.8 | ○ | 0.051 | 0.079 | ○ | 0.003 | 0.002 | 456 | 355 | 0.78 | Example |
| 23 | A | 600 | 1.4 | 1.0 | ○ | 490 | 10.0 | ○ | 0.072 | 0.100 | ○ | 0.006 | 0.001 | 462 | 370 | 0.80 | Example |
| 24 | B | 600 | 1.4 | 1.0 | X | 490 | 10.5 | ○ | 0.040 | 0.030 | X | 0.004 | 0.003 | 638 | 500 | 0.78 | Comparative Example |
| 25 | B | 650 | 2.2 | 1.3 | ○ | 500 | 11.0 | ○ | 0.068 | 0.068 | ○ | 0.003 | 0.004 | 630 | 475 | 0.75 | Example |
| 26 | C | 650 | 2.2 | 1.3 | X | 500 | 10.5 | ○ | 0.028 | 0.029 | X | 0.002 | 0.006 | 790 | 555 | 0.70 | Comparative Example |
| 27 | C | 700 | 2.9 | 1.6 | ○ | 500 | 9.4 | ○ | 0.057 | 0.052 | ○ | 0.006 | 0.001 | 799 | 570 | 0.71 | Example |
| 28 | D | 800 | 4.4 | 2.2 | X | 530 | 10.1 | X | 0.012 | 0.012 | X | 0.004 | 0.008 | 818 | 550 | 0.67 | Comparative Example |
| 29 | D | 850 | 5.2 | 2.6 | ○ | 530 | 10.1 | ○ | 0.074 | 0.056 | ○ | 0.004 | 0.006 | 840 | 565 | 0.67 | Example |
| 30 | E | 850 | 5.2 | 2.6 | ○ | 510 | 9.3 | ○ | 0.070 | 0.098 | ○ | 0.009 | 0.004 | 1038 | 700 | 0.67 | Example |
| 31 | F | 850 | 5.2 | 2.6 | ○ | 520 | 10.9 | ○ | 0.069 | 0.090 | ○ | 0.002 | 0.003 | 1187 | 800 | 0.67 | Example |
| 32 | F | 800 | 4.4 | 2.2 | X | 520 | 9.8 | X | 0.024 | 0.036 | X | 0.004 | 0.002 | 1191 | 825 | 0.69 | Comparative Example |
| 33 | G | 750 | 3.7 | 1.9 | ○ | 450 | 7.0 | ○ | 0.080 | 0.082 | ○ | 0.016 | 0.013 | 652 | 375 | 0.58 | Comparative Example |
| 34 | H | 750 | 3.7 | 1.9 | ○ | 550 | 14.6 | ○ | 0.099 | 0.090 | ○ | 0.001 | 0.001 | 998 | 755 | 0.76 | Example |
| 35 | H | 700 | 2.9 | 1.6 | ○ | 520 | 10.2 | ○ | 0.081 | 0.069 | ○ | 0.006 | 0.007 | 990 | 690 | 0.70 | Example |
| 36 | H | 650 | 2.2 | 1.3 | X | 520 | 10.1 | ○ | 0.033 | 0.055 | X | 0.004 | 0.005 | 994 | 680 | 0.68 | Comparative Example |
| 37 | I | 700 | 2.9 | 1.6 | ○ | 520 | 9.9 | ○ | 0.055 | 0.089 | ○ | 0.006 | 0.003 | 1201 | 800 | 0.67 | Example |
| 38 | J | 700 | 2.9 | 1.6 | X | 490 | 9.8 | X | 0.023 | 0.017 | X | 0.006 | 0.009 | 834 | 560 | 0.67 | Comparative Example |
| 39 | K | 700 | 2.9 | 1.6 | X | 550 | 10.0 | X | 0.038 | 0.022 | X | 0.002 | 0.002 | 1423 | 950 | 0.67 | Comparative Example |
| 40 | L | 700 | 2.9 | 1.6 | ○ | 500 | 10.5 | ○ | 0.051 | 0.103 | ○ | 0.002 | 0.001 | 1219 | 830 | 0.68 | Example |

Under lined value is out of range according to the present invention.
*1A = 0.015T − 7.6 (T ≥ 507° C.)
A = 0 (T ≤ 506° C.)
*2B = 0.0063T − 2.8 (T ≥ 445° C.)
B = 0 (T ≤ 444° C.)
*3[Si] + A[Cr] ≤ B: ○
[Si] + A[Cr] > B: X,
where [Si] and [Cr] respectively represent contents (mass %) of Si and Cr in steel.

Table 3 clearly indicates that a galvannealed steel sheet which was manufactured by our method (Example) was excellent in terms of coating adhesiveness, surface appearance and fatigue resistance, even though it was high strength steel which contains Si, Mn, and Cr. On the other hand, a galvanized steel sheet which was manufactured by the method which was out of our range (Comparative Example) was poor in terms of one or more of coating adhesiveness, surface appearance and fatigue resistance.

Example 3

The steels having the chemical compositions given in Table 1 were smelted and the obtained slabs were hot-rolled, pickled and cold-rolled into cold-rolled steel sheets having a thickness of 1.2 mm.

Then, an oxidation treatment, reduction annealing, plating, and an alloying treatment were performed using the same methods as used in Example 2. However, an oxidation furnace was divided into three zones and the exit temperatures and concentrations of oxygen of the atmospheres of these zones were respectively adjusted by respectively varying the burning rates and air ratios of these zones.

As for the galvanized steel sheets obtained as described above, the coating weight and the Fe content of the coating layer were determined. Moreover, the amounts of Si and Mn in the form of oxides which are present in the coating layer and in the region of the steel sheet within 5 μm from the surface of the steel sheet under the coating layer were determined and surface appearance and coating adhesiveness were evaluated. The coating weight, the Fe content of the coating layer, the amounts of Si and Mn, and surface appearance and coating adhesiveness were evaluated using the same methods as used in Example 1.

The results obtained as described above are given in Table 4 in combination with the manufacturing conditions.

TABLE 4

| | | Exit Temperature of Oxidation Furnace T(° C.) | | | | | | | | | | | |
|---|---|---|---|---|---|---|---|---|---|---|---|---|---|
| | | Oxidation Furnace 1 | | Oxidation Furnace 2 | | Oxidation Furnace 3 | | | | Oxygen Concentration of Oxidation Furnace (ppm) | | | Alloy-ing |
| No. | Steel Grade | Exit Temperature $T_1$ | Judgment*1 | Exit Temperature $T_2$ | Judgment*2 | Exit Temperature T | A*3 | B*4 | Judgment*5 | Oxidation Furnace 1 | Oxidation Furnace 2 | Oxidation Furnace 3 | Temperature (° C.) |
| 41 | C | 350 | ○ | 620 | ○ | 650 | 2.2 | 1.3 | X | 500 | 10000 | 500 | 500 |
| 42 | C | 400 | ○ | 630 | X | 700 | 2.9 | 1.6 | ○ | 500 | 10000 | 500 | 500 |
| 43 | C | 400 | ○ | 660 | ○ | 700 | 2.9 | 1.6 | ○ | 500 | 10000 | 500 | 520 |
| 44 | C | 400 | ○ | 680 | ○ | 700 | 2.9 | 1.6 | ○ | 500 | 10000 | 500 | 470 |
| 45 | C | 250 | X | 670 | ○ | 700 | 2.9 | 1.6 | ○ | 500 | 10000 | 500 | 500 |
| 46 | C | 350 | ○ | 670 | ○ | 700 | 2.9 | 1.6 | ○ | 500 | 10000 | 500 | 500 |
| 47 | C | 470 | X | 670 | ○ | 700 | 2.9 | 1.6 | ○ | 500 | 10000 | 500 | 500 |
| 48 | C | 400 | ○ | 680 | ○ | 700 | 2.9 | 1.6 | ○ | 3000 | 10000 | 500 | 500 |
| 49 | C | 400 | ○ | 680 | ○ | 700 | 2.9 | 1.6 | ○ | 500 | 500 | 500 | 490 |
| 50 | C | 400 | ○ | 680 | ○ | 700 | 2.9 | 1.6 | ○ | 500 | 10000 | 10000 | 450 |
| 51 | C | 400 | ○ | 680 | ○ | 700 | 2.9 | 1.6 | ○ | 10000 | 10000 | 10000 | 490 |
| 52 | F | 500 | ○ | 770 | ○ | 800 | 4.4 | 2.2 | X | 500 | 10000 | 500 | 520 |
| 53 | F | 550 | ○ | 780 | X | 850 | 5.2 | 2.6 | ○ | 500 | 10000 | 500 | 520 |
| 54 | F | 550 | ○ | 810 | ○ | 850 | 5.2 | 2.6 | ○ | 500 | 10000 | 500 | 530 |
| 55 | F | 550 | ○ | 830 | ○ | 850 | 5.2 | 2.6 | ○ | 500 | 10000 | 500 | 540 |
| 56 | F | 250 | X | 820 | ○ | 850 | 5.2 | 2.6 | ○ | 500 | 10000 | 500 | 530 |
| 57 | F | 500 | ○ | 820 | ○ | 850 | 5.2 | 2.6 | ○ | 500 | 10000 | 500 | 520 |
| 58 | F | 620 | X | 820 | ○ | 850 | 5.2 | 2.6 | ○ | 500 | 10000 | 500 | 500 |
| 59 | F | 550 | ○ | 830 | ○ | 850 | 5.2 | 2.6 | ○ | 3000 | 10000 | 500 | 510 |
| 60 | F | 550 | ○ | 830 | ○ | 850 | 5.2 | 2.6 | ○ | 500 | 500 | 500 | 450 |

| Fe Content in Coating Layer (mass %) | Coating Surface Appearance | Amount of Si in Oxides in Coating Layer ($g/m^2$) | Amount of Mn in Oxides in Coating Layer ($g/m^2$) | Coating Adhesiveness | Amount of Si in Oxides within 5 μm from Surface of Steel Sheet ($g/m^2$) | Amount of Mn in Oxides within 5 μm from Surface of Steel Sheet ($g/m^2$) | Tensile Strength (MPa) | Tensile Fatigue Limit (MPa) | Endurance Ratio | |
|---|---|---|---|---|---|---|---|---|---|---|
| 9.9 | X | 0.038 | 0.042 | X | 0.002 | 0.003 | 764 | 535 | 0.70 | Comparative Example |
| 9.8 | ○ | 0.052 | 0.056 | ○ | 0.005 | 0.004 | 791 | 540 | 0.68 | Example |
| 10.9 | ○ | 0.066 | 0.061 | ⊙ | 0.003 | 0.005 | 812 | 575 | 0.71 | Example |
| 9.0 | ○ | 0.071 | 0.073 | ⊙ | 0.007 | 0.004 | 805 | 595 | 0.74 | Example |
| 9.7 | ○ | 0.062 | 0.065 | ○ | 0.004 | 0.002 | 799 | 570 | 0.71 | Example |
| 10.1 | ○ | 0.070 | 0.062 | ⊙ | 0.002 | 0.003 | 806 | 575 | 0.71 | Example |
| 9.8 | ○ | 0.068 | 0.061 | ○ | 0.007 | 0.005 | 801 | 550 | 0.69 | Example |
| 10.0 | ○ | 0.072 | 0.068 | ⊙ | 0.005 | 0.007 | 786 | 515 | 0.66 | Example |
| 9.4 | ○ | 0.052 | 0.055 | ○ | 0.008 | 0.006 | 795 | 535 | 0.67 | Example |
| 8.5 | ○ | 0.065 | 0.068 | ○ | 0.018 | 0.014 | 789 | 460 | 0.58 | Comparative Example |
| 9.4 | ○ | 0.057 | 0.052 | ○ | 0.007 | 0.003 | 824 | 510 | 0.62 | Example |
| 10.5 | ○ | 0.038 | 0.040 | X | 0.002 | 0.003 | 1191 | 790 | 0.66 | Comparative Example |
| 10.2 | ○ | 0.051 | 0.055 | ○ | 0.003 | 0.005 | 1198 | 805 | 0.67 | Example |
| 10.5 | ○ | 0.066 | 0.054 | ⊙ | 0.002 | 0.002 | 1187 | 825 | 0.70 | Example |
| 11.0 | ○ | 0.074 | 0.077 | ⊙ | 0.002 | 0.002 | 1206 | 800 | 0.66 | Example |
| 10.5 | ○ | 0.062 | 0.060 | ○ | 0.004 | 0.003 | 1211 | 790 | 0.65 | Example |
| 10.1 | ○ | 0.065 | 0.059 | ⊙ | 0.003 | 0.005 | 1205 | 820 | 0.68 | Example |
| 9.8 | ○ | 0.052 | 0.059 | ○ | 0.006 | 0.005 | 1191 | 815 | 0.68 | Example |

TABLE 4-continued

| | | | | | | | | | | |
|---|---|---|---|---|---|---|---|---|---|---|
| 10.1 | ○ | 0.061 | 0.065 | ○ | 0.005 | 0.004 | 1205 | 830 | 0.69 | Example |
| 7.8 | ○ | 0.050 | 0.054 | ○ | 0.015 | 0.014 | 1199 | 710 | 0.59 | Comparative Example |

Under lined value is out of range according to the present invention.
*1(T − 350)° C. or higher and (T − 250)° C. or lower: ○
*2(T − 50)° C. or higher: ○
*3A = 0.015T − 7.6 (T ≥ 507° C.)
A = 0 (T ≤ 506° C.)
*4B = 0.0063T − 2.8 (T ≥ 445° C.)
B = 0 (T ≤ 444° C.)
*5[Si] + A[Cr] ≤ B: ○
[Si] + A[Cr] > B: X,
where [Si] and [Cr] respectively represent contents (mass %) of Si and Cr in steel.

Table 4 clearly indicates that a galvannealed steel sheet which was manufactured by our method (Example) was excellent in terms of coating adhesiveness, surface appearance, and fatigue resistance, even though it was high strength steel sheet which contains Si, Mn, and Cr. Moreover, the cases where the exit temperatures and concentrations of oxygen of the oxidation furnaces 1 through 3 are in our range are in particular excellent in terms of coating adhesiveness. On the other hand, a galvanized steel sheet which was manufactured by the method which was out of our range (Comparative Example) was poor in terms of one or more of coating adhesiveness, surface appearance and fatigue resistance.

Example 4

The steels having the chemical compositions given in Table 1 were smelted and the obtained slabs were hot-rolled, pickled, and cold-rolled into cold-rolled steel sheets having a thickness of 1.2 mm.

Then, an oxidation treatment, reduction annealing, plating, and an alloying treatment were performed using the same methods as used in Example 2. As for the galvanized steel sheets obtained as described above, surface appearance, coating adhesiveness, and corrosion resistance were evaluated. Moreover, taking in of the crystal grains of the base steel into the coating layer was investigated.

Taking in of the crystal gains of the base steel into the coating layer was investigated using the following methods. A sample which had been subjected to an alloying treatment was embedded in epoxy resin and polished, and then the backscattered electron image of the embedded sample, which was taken using SEM, was observed. Since the contrast of the backscattered electron image varies depending on an atomic number as described above, it is possible to clearly distinguish the coating layer and the base steel. Therefore, from this observation image, the evaluation of a case with taking in of the crystal grains of the base steel into the coating layer is represented by x, and the evaluation of a case without taking in of the crystal grains of the base steel is represented by ○.

In addition, corrosion resistance was evaluated using the following methods. Using a sample which had been subjected to an alloying treatment, a combined cyclic corrosion test according to SAE-J2334, which includes processes of drying, wetting, and spraying of neutral salt, was conducted. Corrosion resistance was evaluated by measuring the maximum corrosion depth using a point micrometer after the removal of the coating layer and the rust (dipping in a diluted hydrochloric acid solution).

Surface appearance and coting adhesiveness were evaluated using the same methods as used in Example 1.

The results obtained as described above are given in Table 5 in combination with the manufacturing conditions.

TABLE 5

| No. | Steel Grade | Exit Temperature of Oxidation Furnace T(° C.) | A*1 | B*2 | Judgment*3 | Judgment*4 | Coating Surface Appearance | Coating Adhesiveness | Take-in of Crystal Grains of Base Steel into Coating Layer | Maximum Corrosion Depth (mm) | |
|---|---|---|---|---|---|---|---|---|---|---|---|
| 61 | A | 500 | 0.0 | 0.4 | X | ○ | ○ | X | ○ | 0.45 | Comparative Example |
| 62 | A | 550 | 0.7 | 0.7 | ○ | ○ | ○ | ○ | ○ | 0.38 | Example |
| 63 | A | 600 | 1.4 | 1.0 | ○ | ○ | ○ | ○ | ○ | 0.41 | Example |
| 64 | B | 600 | 1.4 | 1.0 | X | ○ | ○ | X | ○ | 0.31 | Comparative Example |
| 65 | B | 650 | 2.2 | 1.3 | ○ | ○ | ○ | ○ | ○ | 0.48 | Example |
| 66 | C | 650 | 2.2 | 1.3 | X | ○ | ○ | X | ○ | 0.36 | Comparative Example |
| 67 | C | 700 | 2.9 | 1.6 | ○ | ○ | ○ | ○ | ○ | 0.35 | Example |
| 68 | D | 800 | 4.4 | 2.2 | X | ○ | X | X | ○ | 0.42 | Comparative Example |
| 69 | D | 850 | 5.2 | 2.6 | ○ | X | ○ | ○ | X | 0.58 | Example |
| 70 | G | 750 | 3.7 | 1.9 | ○ | ○ | ○ | ○ | ○ | 0.37 | Example |
| 71 | G | 800 | 4.4 | 2.2 | ○ | ○ | ○ | ○ | ○ | 0.45 | Example |
| 72 | G | 820 | 4.7 | 2.4 | ○ | X | ○ | ○ | X | 0.50 | Example |
| 73 | G | 850 | 5.2 | 2.6 | ○ | X | ○ | ○ | X | 0.61 | Example |
| 74 | H | 650 | 2.2 | 1.3 | X | ○ | X | X | ○ | 0.44 | Comparative Example |

TABLE 5-continued

| No. | Steel Grade | Exit Temperature of Oxidation Furnace T(° C.) | A*1 | B*2 | Judgment*3 | Judgment*4 | Coating Surface Appearance | Coating Adhesive-ness | Take-in of Crystal Grains of Base Steel into Coating Layer | Maximum Corrosion Depth (mm) | |
|---|---|---|---|---|---|---|---|---|---|---|---|
| 75 | H | 700 | 2.9 | 1.6 | ○ | ○ | ○ | ○ | ○ | 0.48 | Example |
| 76 | H | 750 | 3.7 | 1.9 | ○ | X | ○ | ○ | X | 0.53 | Example |

*1A = 0.015T − 7.6 (T ≥ 507° C.)
A = 0 (T ≤ 506° C.)
*2B = 0.0063T − 2.8 (T ≥ 445° C.)
B = 0 (T ≤ 444° C.)
*3[Si] + A[Cr] ≤ B: ○
[Si] + A[Cr] > B: X,
*4T ≤ −80[Mn]-75[Si] + 1030: ○
T > −80[Mn]-75[Si] + 1030: X
Here, [Si], [Mn] and [Cr] respectively represent contents (mass %) of Si, Mn and Cr in steel.

Table 5 clearly indicates that a galvannealed steel sheet which was manufactured by our method (Example) was excellent in terms of coating adhesiveness, and surface appearance, even though it was high strength steel sheet which contains Si, Mn, and Cr. Moreover, the cases where judgment *4 given in Table 5 is satisfied are without taking in of the crystal grains of the based layer into the coating layer and excellent in terms of corrosion resistance. On the other hand, a galvanized steel sheet which was manufactured by the method which was out of our range (Comparative Example) was poor in terms of one or more of coating adhesiveness, surface appearance, and corrosion resistance.

INDUSTRIAL APPLICABILITY

Since the high strength galvanized steel sheet is excellent in terms of coating adhesiveness and fatigue resistance, the steel sheet can be used as a surface-treated steel sheet which is effective to decrease the weight of an automobile body and increase the strength of an automobile body.

The invention claimed is:

1. A method of manufacturing a high strength galvanized steel sheet excellent in terms of coating adhesiveness comprising:

performing an oxidation treatment on steel containing Si, Mn, and Cr in an oxidation furnace under a condition that an exit temperature T satisfies expressions below, performing reduction annealing, and performing a galvanizing treatment without performing an alloying treatment:

$$A=0.015T-7.6\ (T\geq 507^\circ\ C.),$$

$$A=0\ (T<507^\circ\ C.),$$

$$B=0.0063T-2.8\ (T\geq 445^\circ\ C.),$$

$$B=0\ (T<445^\circ\ C.),$$

$$[Si]+A\times[Cr]\leq B,$$

where [Si]: Si content of the steel by mass %, and

[Cr]: Cr content of the steel by mass %, wherein the oxidation furnace includes three or more zones in which atmospheres can be individually controlled and which are called oxidation furnace 1, oxidation furnace 2, oxidation furnace 3 and so on in ascending order of distance from the entrance of the furnace, in which atmospheres of the oxidation furnace 1 and the oxidation furnace 3 have an oxygen concentration of less than 1000 vol.ppm and the balance being $N_2$, CO, $CO_2$, $H_2O$ and inevitable impurities and the atmosphere of the oxidation furnace 2 has an oxygen concentration of 1000 vol.ppm or more and the balance being $N_2$, CO, $CO_2$, $H_2O$ and inevitable impurities.

2. The method according to claim 1, wherein an exit temperature $T_2$ of the oxidation furnace 2 is (the exit temperature T−50)° C. or higher.

3. The method according to claim 2, wherein an exit temperature $T_1$ of the oxidation furnace 1 is (the exit temperature T−350)° C. or higher and lower than (the exit temperature T−250)° C.

4. The method according to claim 1, wherein an exit temperature $T_1$ of the oxidation furnace 1 is (the exit temperature T−350)° C. or higher and lower than (the exit temperature T−250)° C.

5. The method according to claim 1, wherein the steel has a chemical composition containing C: 0.01 mass % or more and 0.20 mass % or less, Si: 0.5 mass % or more and 2.0 mass % or less, Mn: 1.0 mass % or more and 3.0 mass % or less, Cr: 0.01 mass % or more and 0.4 mass % or less and the balance being Fe and inevitable impurities.

6. A method of manufacturing a high strength galvanized steel sheet excellent in terms of coating adhesiveness comprising:

performing an oxidation treatment on steel containing Si, Mn, and Cr in an oxidation furnace under a condition that an exit temperature T satisfies expressions below, performing reduction annealing, performing a galvanizing treatment, and performing an alloying treatment under conditions that heating is performed at a temperature of 460° C. or higher and 600° C. or lower for an alloying treatment time of 10seconds or more and 60 seconds or less:

$$A=0.015T-7.6\ (T\geq 507^\circ\ C.),$$

$$A=0\ (T<507^\circ\ C.),$$

$$B=0.0063T-2.8\ (T\geq 445^\circ\ C.),$$

$$B=0\ (T<445^\circ\ C.),$$

$$[Si]+A\times[Cr]\leq B,$$

where [Si]: Si content of the steel by mass %, and

[Cr]: Cr content of the steel by mass %%, wherein the oxidation furnace includes three or more zones in which atmospheres can be individually controlled and which are called oxidation furnace 1, oxidation furnace 2, oxidation furnace 3 and so on in ascending order of distance from the entrance of the furnace, in which atmospheres of the oxidation furnace 1 and the oxidation furnace 3 have an oxygen concentration of less than 1000 vol.ppm and the balance being $N_2$, CO, $CO_2$, $H_2O$ and inevitable impurities and the atmosphere of the oxidation furnace 2 has an oxygen concentration of 1000 vol.ppm or more and the balance being $N_2$, CO, $CO_2$, $H_2O$ and inevitable impurities.

7. The method according to claim 6, wherein an exit temperature T further satisfies:

$$T \leq -80[Mn]-75[Si]+1030,$$

where [Si]: Si content of the steel by mass %, and

[Mn]: Mn content of the steel by mass %.

8. The method for manufacturing a high strength galvanized steel sheet excellent in terms of coating adhesiveness according to claim 6, wherein the steel has a chemical composition containing C: 0.01 mass % or more and 0.20mass % or less, Si: 0.5 mass % or more and 2.0 mass % or less, Mn: 1.0 mass % or more and 3.0mass % or less, Cr: 0.01 mass % or more and 0.4 mass % or less and the balance being Fe and inevitable impurities.

9. The method according to claim 6, wherein an exit temperature $T_2$ of the oxidation furnace 2 is (the exit temperature T−50)° C. or higher.

10. The method according to claim 6, wherein an exit temperature $T_2$ of the oxidation furnace 1 is (the exit temperature T−350)° C. or higher and lower than (the exit temperature T−250)° C.

* * * * *